US008869474B2

(12) United States Patent
Yoon

(10) Patent No.: US 8,869,474 B2
(45) Date of Patent: Oct. 28, 2014

(54) APPARATUS FOR FIXING A GLASS SHEET FOR ELEVATOR'S DOOR

(76) Inventor: Il Shik Yoon, Gyeonggi-do (KR)

( * ) Notice: Subject to any disclaimer, the term of this patent is extended or adjusted under 35 U.S.C. 154(b) by 0 days.

(21) Appl. No.: 13/133,721

(22) PCT Filed: Dec. 8, 2009

(86) PCT No.: PCT/KR2009/007288

§ 371 (c)(1),
(2), (4) Date: Jun. 9, 2011

(87) PCT Pub. No.: WO2010/071315

PCT Pub. Date: Jun. 24, 2010

(65) Prior Publication Data

US 2011/0243651 A1 Oct. 6, 2011

(30) Foreign Application Priority Data

Dec. 16, 2008 (KR) ..... 10 2008 0127686

(51) Int. Cl.
*E06B 3/00* (2006.01)
*B66B 13/30* (2006.01)

(52) U.S. Cl.
CPC ..... *B66B 13/303* (2013.01)
USPC ..... 52/208; 49/501

(58) Field of Classification Search
USPC ..... 52/208, 204, 207; 49/501, 381
See application file for complete search history.

(56) References Cited

U.S. PATENT DOCUMENTS

| | | | | | |
|---|---|---|---|---|---|
| 1,921,752 | A | * | 8/1933 | Hess | 52/785.1 |
| 4,624,094 | A | * | 11/1986 | Schwindt | 52/785.1 |
| 4,673,152 | A | * | 6/1987 | Brown | 248/216.1 |
| 5,139,111 | A | * | 8/1992 | Baumann et al. | 187/333 |
| 5,398,452 | A | * | 3/1995 | Schilde et al. | 49/501 |
| 5,546,714 | A | * | 8/1996 | Kenkel | 52/204.5 |
| 5,568,713 | A | * | 10/1996 | Gagne et al. | 52/785.1 |
| 6,202,798 | B1 | * | 3/2001 | Friedman et al. | 187/333 |
| 6,205,713 | B1 | * | 3/2001 | Thompson et al. | 49/465 |
| 6,715,245 | B2 | * | 4/2004 | Lewkowitz | 52/208 |
| 7,707,776 | B2 | * | 5/2010 | Weissofner et al. | 49/388 |
| 7,861,472 | B2 | * | 1/2011 | Thompson | 52/208 |
| 2009/0277109 | A1 | * | 11/2009 | Taylor et al. | 52/208 |

FOREIGN PATENT DOCUMENTS

| | | | |
|---|---|---|---|
| JP | 09-252657 | | 9/1997 |
| JP | 09252657 | A * | 9/1997 |
| KR | 20-0400601 | | 11/2005 |
| WO | 2008/010271 | | 1/2008 |

* cited by examiner

*Primary Examiner* — Brian Glessner
*Assistant Examiner* — Paola Agudelo
(74) *Attorney, Agent, or Firm* — Mark M. Friedman

(57) ABSTRACT

The present invention relates to a fixing apparatus that makes it possible to easily attach/detach an ornamental glass sheet to the surface of an elevator door and provides an apparatus for fixing a glass sheet for an elevator door which includes: a rear sheet 10 that is made of an elastic material and disposed between the glass sheet 20, which is attached to the outer surface of the elevator door D, and the elevator door D to support the glass sheet 20; and a fixing means F that is installed along the edge of the glass sheet 20 and fixes the glass sheet to the elevator door D.

5 Claims, 5 Drawing Sheets

Fig. 2
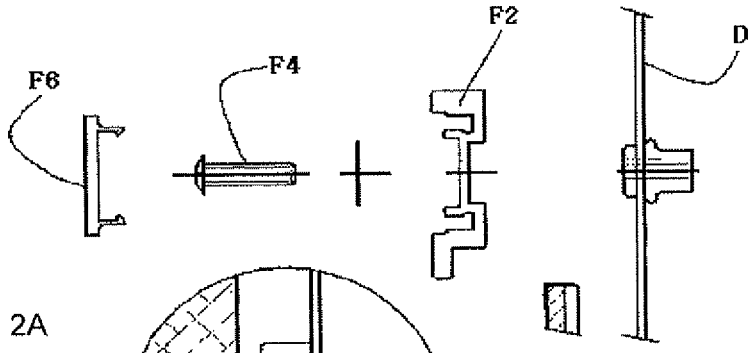
Fig. 2A
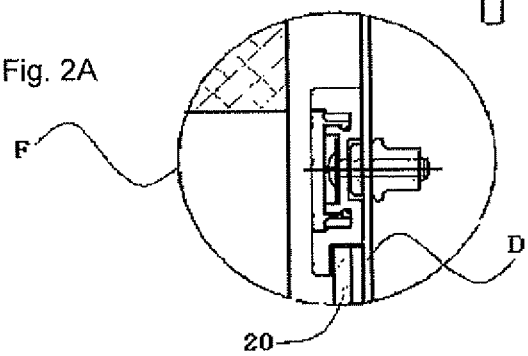
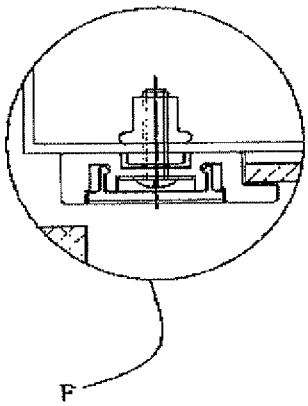
Fig. 3
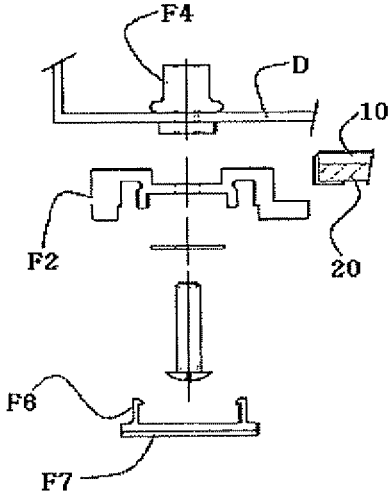
Fig. 3A

Fig. 4
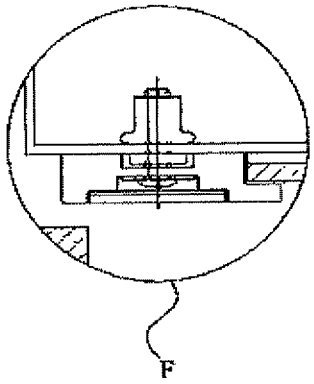
Fig. 4A
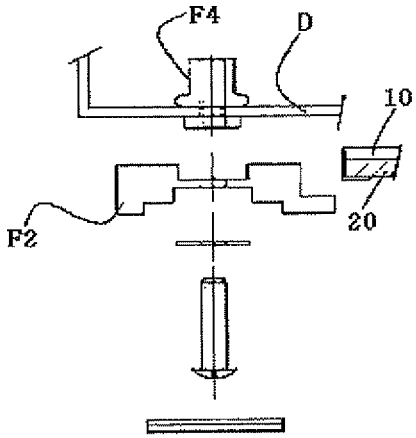
Fig. 5
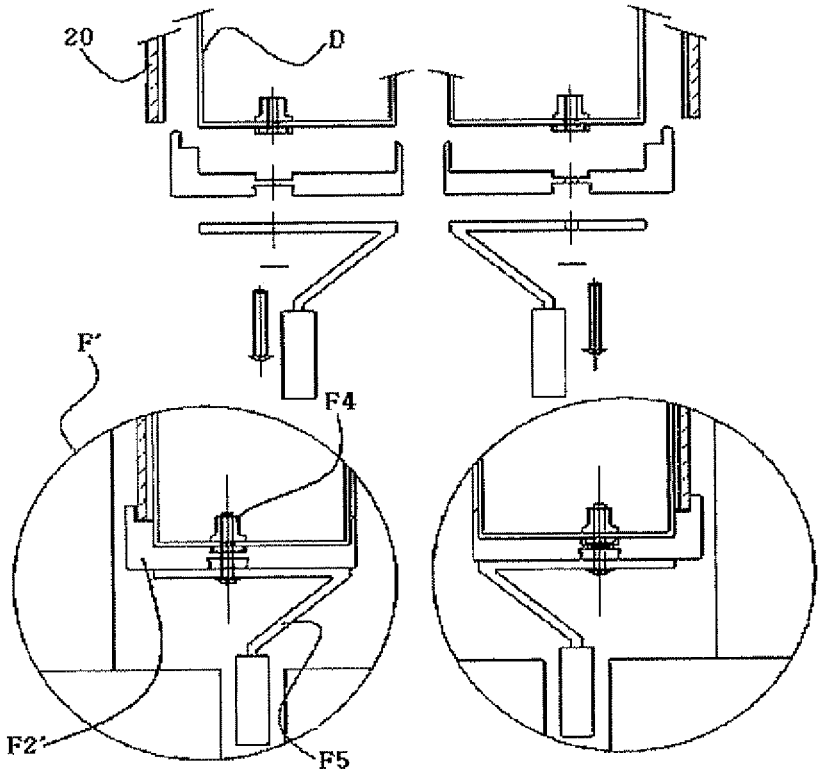
Fig. 5A
Fig. 5B

Fig. 6
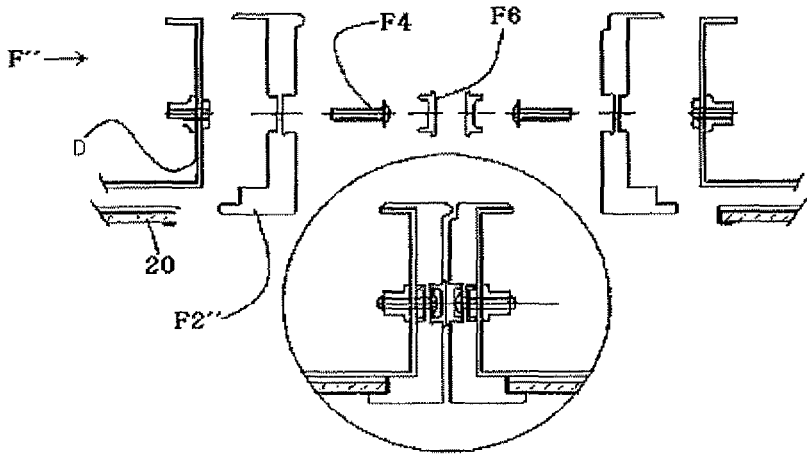
Fig. 6A
Fig. 7
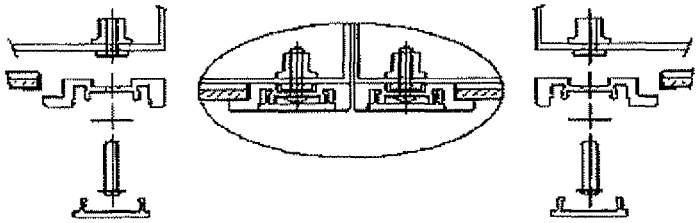
Fig. 7B Fig. 7A

APPARATUS FOR FIXING A GLASS SHEET FOR ELEVATOR'S DOOR

TECHNICAL FIELD

The present invention relates to an apparatus for fixing an ornamental sheet to the door surface of an elevator, in detail, a fixing apparatus that makes it possible to easily attach/detach an ornamental glass sheet onto the surface of an elevator door.

BACKGROUND ART

Recently, it is increasing to attach a glass sheet for ornament to the surface of elevators to increase the aesthetic quality of the elevators.

FIGS. 1, F-F' and E-E' shows an example of installing a glass sheet in the related art, in which FIG. 1 is a front view of an elevator door, FIG. F-F' is a cross-sectional view taken along the line F-F' of FIG. 1, and FIG. E-E' is a cross-sectional view taken along the line E-E' of FIG. 1.

As can be seen from the cross-sectional views of FIGS. F-F' and E-E', a glass sheet 20 is placed on the outer surface of an elevator door D, which is generally formed of a metal sheet, and both sides including the upper and lower ends are attached by U-shaped couplers 2, the glass sheet 20 is firmly fixed by L-shaped supports 4 at both sides and the upper and lower ends of the inner surface of the door D, and then the door formed as described above is installed onto elevators. That is, an ornamental glass sheet is attached in advance to an elevator door before the elevator is installed a in building.

When it is required to replace the glass sheet that has been installed as an ornamental sheet, due to breakage or damage by shock or other causes, large amount of time and cost are needed for maintenance, because it is possible to replace the glass sheet after disassembling the entire door. Further, since it is required to disassemble the entire door, many safety accidents may occur while replacing the glass sheet.

DISCLOSURE OF INVENTION

Technical Problem

The present invention addresses the problem described above and it is an object of the present invention to provide a fixing apparatus that makes it possible to simply replace a glass sheet attached to the outer surface of an elevator, at the outside of the elevator.

Solution to Problem

In order to accomplish the object, present invention provides an apparatus for fixing a glass sheet for an elevator door that fixes an ornamental glass sheet 20 to the outer surface of the elevator door, and includes: a rear sheet 10 that is made of an elastic material and disposed between the glass sheet 20, which is attached to the outer surface of the elevator door D, and the elevator door D to support the glass sheet 20; and a fixing means F that is installed along the edge of the glass sheet 20 and fixes the glass sheet to the elevator door D.

In the apparatus for fixing a glass sheet for an elevator door according to the present invention, it is preferable that the fixing means F includes: a long support F2 that is installed along the edge of the glass sheet to simultaneously support the edge and the outer surface of the glass sheet 20; a fastener F4 that includes a screw and a bolt passing through and fixing the support F2 to the door D; and a cover F6 that is fitted and fixed to the support F2 while covering the fastener F4.

In this configuration, the apparatus for fixing a glass sheet for an elevator door according to the present invention may further include a lower end fixing means F that includes: a support F2' that is installed along the lower edges of the glass sheet and the door D to simultaneously support the lower edge and the outer surface of the glass sheet 20; a prop F5 that supports the support F2' and of which one end is fixed to the doorframe; and a fastener F4 that includes a screw and a bolt passing through and fixing the support F2' and the prop F5 to the lower end of the door D. Further, the lower end fixing means F may be installed at the upper end of the glass sheet.

Further, the apparatus for fixing a glass sheet for an elevator door may further include a side fixing means F" that includes: a support F2" that is installed along the side edges of the glass sheet and the door D to simultaneously support the side edges and the outer surface of the glass sheet 20; a fastener F4 that includes a screw and a bolt passing through and fixing the support F2" to the side of the door D; and a cover F6 that is fitted and fixed to the support F2" while covering the fastener F4.

Meanwhile, in the fixing apparatus, if needed, the glass sheet 20 and the rear sheet 10 may be divided up and down into two parts, respectively, in which it is preferable that the upper and rear glass sheets 20 and the rear sheet 10 are fixed by a long cross-support that has grooves 32 at the upper and lower portions, where both of the upper and lower glass sheets 20 are fitted, between the upper and lower glass sheets 20 and the rear seat 10, and a space defined between the upper and lower grooves 32 throughout the width of the glass sheet, the cross-support 30 is reinforced by a crossbar 34 that is disposed in the central space of the cross-support 30 along the cross-support 30, and both ends of the crossbar 34 protrude from both sides of the cross-support 30 and are fixed to the supports F2, F2" at both sides of the door.

Advantageous Effects of Invention

According to the fixing apparatus having the above configuration according to the present invention, since it is possible to install the glass sheet, at the outside of the door after installing the elevator door to a cage, the time and cost for installing are considerably reduced and safety is ensured in work. Further, it is possible to replace the glass sheet by simply separating the fixing apparatus, at the outside of the door without disassembling the door, even if the glass sheet breaks.

BRIEF DESCRIPTION OF DRAWINGS

FIGS. 1, F-F' and E-E' shows an example of installing a glass sheet in the related art, in which FIG. 1 is a front view of an elevator door, FIG. F-F' is a cross-sectional view taken along the line F-F of FIG. 1, and FIG. E-E' is a cross-sectional view taken along the line E-E' of FIG. 1.

FIGS. 2-2A is across-sectional view showing a representative example of an apparatus for fixing a glass sheet for an elevator door that fixes an ornament glass sheet 20 to the outer surface of an elevator door according to the present invention, in which an exploded view is shown outside the circle (FIG. 2) and an assembly view is shown inside the circle (FIG. 2A).

FIGS. 3-3A and 4-4A are views showing a fixing means F in detail and also showing a modification of a cover F6, in which the assembly is shown inside the circle (FIGS. 3 and 4) and an exploded cross-sectional view is shown outside the circle (FIGS. 3A and 4A).

FIGS. 5, 5A and 5B shows a cross-sectional view and an exploded perspective view (FIG. 5) of a lower fixing means F that is installed at the lower edge of the glass sheet 20 in which a cross-sectional view of the assembly is shown inside the circles (FIGS. 5A and 5B).

FIGS. 6,6A is an exploded cross-sectional view (FIG. 6) and an assembled cross-sectional view (FIG. 6A) of a fixing means F" that is suitable for the installation along the side of the glass sheet 20, particularly, the portion where doors contact with each other.

FIGS. 7,7A and 7B is a cross-sectional view showing an example of using the fixing means F to the side of the glass sheet 20, in which a cross-sectional view showing both doors contacting with each other is shown in the circle (FIG. 7B).

FIG. 5C is a partial front view showing in detail a cross-support 30 in the above structure, FIG. K-K' is a cross-sectional view taken along the line K-K' of FIG. 8C, and FIG. L-L' is a cross-sectional view taken along the line L-L' of FIG. 8C.

BEST MODE FOR CARRYING OUT THE INVENTION

Figure 1:
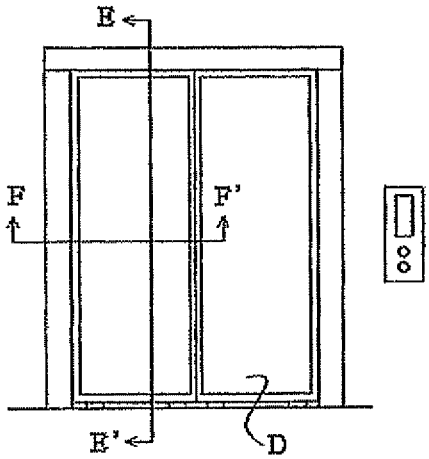
Figure 1:
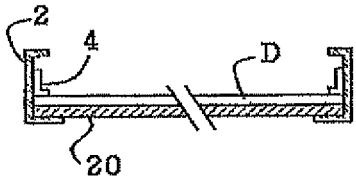
Figure 1:
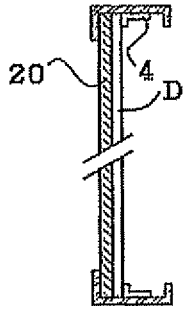

The present invention is described hereafter in detail with reference to the accompanying drawings.

FIGS. 2-2A is a cross-sectional view showing a representative example of an apparatus for fixing a glass sheet for an elevator door that fixes an ornament glass sheet 20 to the outer surface of an elevator door according to the present invention, in which an exploded view is shown outside the circle (FIG. 2) and an assembly view is shown inside the circle (FIG. 2A). In FIGS. 2-2A, although a fixing apparatus that is installed along the upper end of the glass sheet 20 is exemplified, the fixing apparatus can be installed at any of the edges of the glass sheet.

A rear sheet 10 made of an elastic material is disposed between the glass sheet 20 and an elevator door D to protect the glass sheet 20 attached to the outer surface of the elevator door D from external shock. A fixing means F is used to fix the glass sheet to the elevator door D at the edge of the glass sheet 20.

It is preferable that the fixing means F is composed of a support F2, a fastener F4, and a cover F6. The support F2 is a long plate-shaped part that is installed along the edge of the glass sheet to simultaneously support the edge and the outer surface of the glass sheet 20, and as shown in the figures, it should simultaneously support the glass sheet 20, the edge of the rear sheet 10, and the outer surface of the glass sheet 20. The fastener F4 includes a screw and bolt etc. which is fixed through the support F2 to the door D, and as the fastener F4 is tightened up, the support F2 firmly fixes the glass sheet and the rear sheet to the outer surface of the door while being pressed. Further, since it is bad for the aesthetic appearance when the fastener F4, in detail, the head of the fastener is exposed outside, it is preferable to fit and fix the cover F6, which covers the fastener, to the support F2.

FIGS. 3-3A and 4-4A are views showing a fixing means F in detail and also showing a modification of a cover F6, in which an assembly is shown inside the circle and an exploded cross-sectional view is shown outside the circle. A reinforcement member F7 may be additionally attached to the surface of the cover F6. This is for preventing the lower material of the cover from being damaged or broken, because the lower material is a weak material, such as aluminum, in most cases. Further, FIGS. 4-4A shows an example of fixing the cover F4 to the support F2, using an adhesive.

FIGS. 5-5B shows a cross-sectional view and an exploded perspective view of a lower fixing means F that is installed at the lower edge of the glass sheet 20, in which a cross-sectional view of the assembly is shown inside the circle (FIGS. 5A,5B).

The lower fixing means F' is composed of a support F2', a prop F5, and a fastener F4. The horizontal surface 109 of support F2' is installed along the lower edges of the glass sheet and the door D to simultaneously support the lower edge and the outer surface of the glass sheet 20, such that it simultaneously supports the outer surface of the glass sheet as well as the edges of the glass sheet and the rear sheet and the door. The prop F5 functions to support the support F2' and of which one end is fixed to the doorframe, such that horizontal surface 102 of prop F5 supports the support F2' from underneath in this way. The support F2' and the prop F5 are fixed to the lower end of the door D by the fastener F4 passing through the horizontal surface 102 of the prop F5 and the horizontal surface 100 of the support F2' and the fastener includes a screw, a bolt, a rivet, etc.

FIGS. 6-6A is an exploded and assembled cross-sectional view of a fixing means F' that is suitable for installation at the side of the glass sheet 20, particularly, the portion where doors contact with each other.

As shown in the figures, it is preferable that the side fixing means F" is composed of a support F2", a fastener F4, and a cover F6. The support F2" is a long plate-shaped part that is installed along the side edges of the glass sheet and the door D to simultaneously support the side edge and the outer surface of the glass sheet 20 and it has a U-shaped cross section to hold and fix the glass sheet and the rear sheet with one side and the other side of the door with the other side. The fastener F4, as described above, passes through and fixes the support F2" to the door D and includes a screw, a bolt, a rivet, etc. The cover F6 that is a part that functions the same as the cover of the second embodiment described above is fitted and fixed to the support F2" while covering the fastener F4. Alternatively, as described above, it may be fixed by bonding.

Further, it is possible to use the fixing means F having the shape described above to the side of the glass sheet 20, instead of the side fixing means F". FIGS. 7-7B is a cross-sectional view showing an example of using the fixing means F to the side of the glass sheet 20, in which a cross-sectional view showing both doors contacting with each other is shown in the circle (FIG. 7B).

Figure 8:
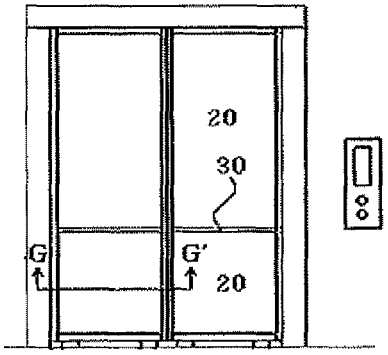
FIG. 8 is a front view of an elevator door with a glass sheet divided up and down, FIG. G-G' is a cross-sectional view taken along the line G-G' of FIG. 8.
Figure 8:
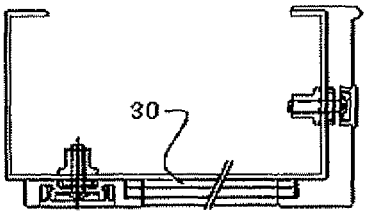
Figure 8C:
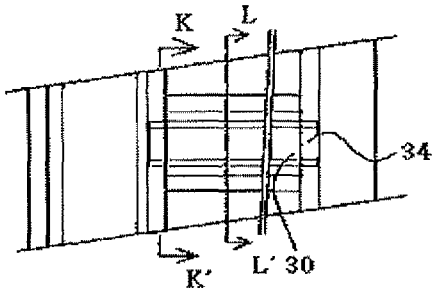
Figure 8C:
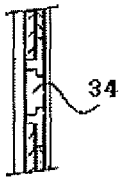
Figure 8C:
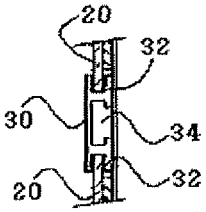

Meanwhile, it is possible to divide the glass sheet 20 into a predetermined number of parts and install them onto the elevator door D. This is for improving the ornamental effect or reducing the possibility of breakage of the glass sheet. The structure when the glass sheet divided up and down into two parts is installed is described with reference to FIG. 8. FIG. 8 is a front view of an elevator door with a glass sheet divided up and down, FIG. G-G' is a cross-sectional view taken along the line G-G' of FIG. 8, FIG. 5C is a partial front view showing in detail a cross-support 30 in the above structure, FIG. K-K' is a cross-sectional view taken along the line K-K' of FIG. 8C, and FIG. L-L' is a cross-sectional view taken along the line L-L' of FIG. 8C.

In order to divide the glass sheet 20 up and down into two parts and fix them, a device supporting the upper and lower glass sheet is required therebetween, in which it is preferable to include a reinforcement means for firmly supporting the side fixing means F2 and F2" described above.

For this purpose, a long cross-support 30 is used to fix both of the glass sheets between the upper and lower glass sheets

20. The cross-support 30 has grooves 32 at the upper and lower portions, where both of the upper and lower glass sheets 20 are fitted, between the upper and lower glass sheets 20 and the rear seat 10. Further, a space is formed between the upper and lower grooves 32 through the entire cross-support 30 and this central space is a space for installing a crossbar 34, which is the reinforcement means. It is preferable that the crossbar 34 is made of a hard material for reinforcement, in detail, steel or metal, and it is preferable that both ends of the crossbar 34 protrude from both sides of the cross-support 30 and are fixed to the supports F2 or F2" at both side of the door. With this configuration, the upper and lower glass sheets 20 can be more firmly supported and fixed as if a gate is barred.

INDUSTRIAL APPLICABILITY

Although a glass sheet was exemplified as an ornamental sheet in the above, this is not more than an example and the present invention can be applied to opaque materials and other ornamental sheets, not a glass sheet.

The invention claimed is:

1. An apparatus for fixing a glass sheet (20) to the outer surface of an elevator door (D), the apparatus comprising:

a rear sheet (10) that is made of an elastic material and is disposed between the glass sheet (20) and the door (D) to support the glass sheet (20);

a first fixing means (F) that fixes the glass sheet to the elevator door (D), said first fixing means (F) comprising:

a long first support (F2) that is installed along an edge of the glass sheet (20) to simultaneously support said edge and an outer surface of the glass sheet (20), a first fastener (F4) comprising a screw or a bolt, wherein said first fastener (F4) passes through and fixes said first support (F2) to the door (D), and a cover (F6) being fitted and fixed to said first support (F2) while covering said first fastener (F4); and a second fixing means (F') that fixes the glass sheet to the elevator door (D), said second fixing means (F') comprising:

a second support (F2), having a horizontal surface that is installed along an upper or lower edge of the glass sheet (20) and the door (D) that simultaneously supports said upper or lower edge of the glass sheet (20) and the outer surface of the glass sheet (20), a prop (F5) having a horizontal surface that contacts and supports said second support (F2'), a second fastener (F4) that passes through the horizontal surface of said second support (F2') and horizontal surface of said prop (F5) and fixes said second support (F2') and said prop (F5) to the edge of the door.

2. The apparatus according to claim 1, further comprising a third fixing means (F") comprising:

a third support (F2") that is installed along a side edge of the glass sheet (20) and the door (D) to simultaneously support said side edge and the outer surface of the glass sheet (20);

a third fastener (F4) that passes through and fixes said third support (F2") to the side of the door (D); and a cover (F6) that is fitted and fixed to said third support (F2") while covering said third fastener (F4).

3. The apparatus according to claim 2, wherein the glass sheet (20) is divided into two parts, an upper part and a lower part, the apparatus further comprising:

upper and lower rear sheets (10);

a long cross-support (30) comprising upper and lower grooves (32) and a space defined between the upper and lower grooves (32), the upper grooves (32) in which are fitted the bottom edge of the upper glass sheet (20) part and upper rear sheet (10), and the lower grooves (32) in which are fitted the upper edge of the lower glass sheet (20) part and lower rear sheet (10); and a crossbar (34) disposed in said space of said cross-support (30);

wherein said cross-support (30) is reinforced by said crossbar (34), and wherein the ends of said crossbar (34) protrude from the cross-support (30) and are fixed to said first support (F2) and said third support (F2").

4. An apparatus for fixing a glass sheet (20) to the outer surface of an elevator door (D), the apparatus comprising:

a rear sheet (10) that is made of an elastic material and is disposed between the glass sheet (20) and the door (D) to support the glass sheet (20);

a first fixing means (F) that fixes the glass sheet to the elevator door (D), said first fixing means (F) comprising:

a long first support (F2) that is installed along an edge of the glass sheet (20) to simultaneously support said edge and an outer surface of the glass sheet (20) and an edge of the rear sheet (10), a first fastener (F4) comprising a screw or a bolt, wherein said first fastener passes through and fixes said first support (F2) to the door (D) without passing through said rear sheet (10), a cover (F6) being fitted and fixed to said first support (F2) while covering said first fastener (F4); and a second fixing means (F") that fixes the glass sheet to the elevator door (D), said second fixing means (F") comprising a second support (F2") that is installed along a side edge of the glass sheet (20) and along the surface of a side edge of the door (D) that wraps around the surface of the side edge of the door (D) and extends over a portion of the front surface of the door (D) and simultaneously supports said side edge of said glass sheet (20 and the outer surface of the glass sheet (20), a second fastener (F4) that passes through and fixes said second support (F2") to the side of the door (D), and a cover (F6) that is fitted and fixed to said second support (F2") while covering said second fastener (F4).

5. The apparatus according to claim 4, wherein the glass sheet (20) is divided into two parts, an upper part and a lower part, the apparatus further comprising:

upper and lower rear sheets (10);

a long cross-support (30) comprising upper and lower grooves (32) and a space defined between the upper and lower grooves (32), the upper grooves (32) in which are fitted the bottom edge of the upper glass sheet (20) part and upper rear sheet (10), and the lower grooves (32) in which are fitted the upper edge of the lower glass sheet (20) part and lower rear sheet (10); and a crossbar (34) disposed in said space of said cross-support (30);

wherein said cross-support (30) is reinforced by said crossbar (34) and wherein the ends of the crossbar (34) protrude from the cross-support (30) and are fixed to said first support (F2) and said second support (F2").

* * * * *